United States Patent [19]

Hendrix et al.

[11] 4,396,390

[45] Aug. 2, 1983

[54] AQUEOUS FORMALDEHYDE TEXTILE FINISHING PROCESS

[75] Inventors: James E. Hendrix; George L. Payet, both of Fort Mill, S.C.

[73] Assignee: Springs Mills, Inc., Fort Mill, S.C.

[21] Appl. No.: 299,477

[22] Filed: Sep. 4, 1981

[51] Int. Cl.[3] ..... D06M 9/00; D06M 13/12

[52] U.S. Cl. ..... 8/116.4; 8/115.7; 427/350; 427/393.2

[58] Field of Search ..... 427/350, 384, 393.2; 8/182, 5, 115.6, 115.7, 116.4; 428/532

[56] References Cited

U.S. PATENT DOCUMENTS

| | | | |
|---|---|---|---|
| 2,311,027 | 2/1943 | Burke et al. | 8/115.5 |
| 3,046,079 | 7/1962 | Reeves et al. | 8/116.4 |
| 3,071,430 | 1/1963 | McCance et al. | 8/116.4 |
| 3,094,372 | 6/1963 | Hibbert et al. | 8/116.4 |
| 3,100,135 | 8/1963 | Sexsmith | 8/116 |
| 3,102,773 | 9/1963 | Needleman | 8/116.3 |
| 3,113,826 | 12/1963 | Daul et al. | 8/116.4 |
| 3,128,147 | 4/1964 | Kenyon et al. | 8/116 |
| 3,130,001 | 4/1964 | Fenner et al. | 8/17 |
| 3,165,374 | 1/1905 | Hushebeck | 8/116.4 |
| 3,173,751 | 3/1965 | Daul et al. | 8/116.4 |
| 3,189,404 | 6/1965 | Takizaki et al. | 8/116.4 |
| 3,190,716 | 6/1965 | Gordon | 8/116.4 |
| 3,190,717 | 6/1965 | King | 8/116.4 |
| 3,254,940 | 6/1966 | Heberlein et al. | 8/116.3 |
| 3,265,463 | 8/1966 | Barber et al. | 8/116.4 |
| 3,275,402 | 9/1966 | Daul et al. | 8/115.6 |
| 3,371,983 | 3/1968 | Barber et al. | 8/116.4 |
| 3,420,696 | 1/1969 | Cotton et al. | 8/116.3 X |
| 3,441,366 | 4/1969 | Pierce et al. | 8/116.3 |
| 3,507,685 | 4/1970 | Banerjee | 8/116.3 X |
| 3,600,123 | 8/1971 | Campbell | 8/116.3 |
| 3,617,192 | 11/1971 | Swidler et al. | 8/116.3 |
| 3,663,974 | 5/1972 | Watanabe et al. | 8/116.4 |
| 3,706,526 | 12/1972 | Swidler et al. | 8/115.7 |
| 3,709,657 | 1/1973 | Hollies et al. | 8/116.3 |
| 3,738,019 | 6/1973 | Forg et al. | 34/210 |
| 3,811,834 | 5/1974 | Schwemmer et al. | 8/185 X |
| 3,841,832 | 2/1973 | Swidler et al. | 8/116.4 |
| 3,960,482 | 6/1976 | Payet | 8/116.4 |
| 3,960,483 | 6/1976 | Payet | 8/116.4 |
| 4,108,598 | 8/1978 | Payet | 8/115.7 |
| 4,118,526 | 10/1978 | Gregorian et al. | 427/350 |

FOREIGN PATENT DOCUMENTS

| | | | |
|---|---|---|---|
| 796815 | 6/1958 | United Kingdom | 427/393.2 |
| 1390473 | 4/1975 | United Kingdom . | |

OTHER PUBLICATIONS

*How Low Can We Go With Low Wet Pick-Up*, America's Textile, R/B Edition, p. 46.

*King's Domain Will Include Corduroy*, Textile World, Feb. 1980, pp. 85, 89.

*Low Add-On Padding*, American Dyestuff Reporter, Aug. 1980, pp. 35, 36, 65.

*Progress of the Triatex MA Process*, International Dyer & Textile Printer, Aug. 24, 1979, p. 165.

*Vacuum Impregnation; A Promising Tool*, Textile Chemist and Colorist, Mar. 1974.

*Formaldehyde Finishing*, Jones, Brian W. et al., Cotton Incorporated, Raleigh, North Carolina.

*Primary Examiner*—Michael R. Lusignan

*Attorney, Agent, or Firm*—Bell, Seltzer, Park & Gibson

[57] ABSTRACT

A process of treating a textile fabric containing cellulosic fibers to impart crease resistance in which the fabric impregnated with an aqueous solution containing formaldehyde and a curing catalyst, vacuum is applied to the impregnated fabric to remove excess impregnation solution and provide a wet pickup of about 15 to 35 percent, and the fabric is then dried and cured.

16 Claims, 1 Drawing Figure

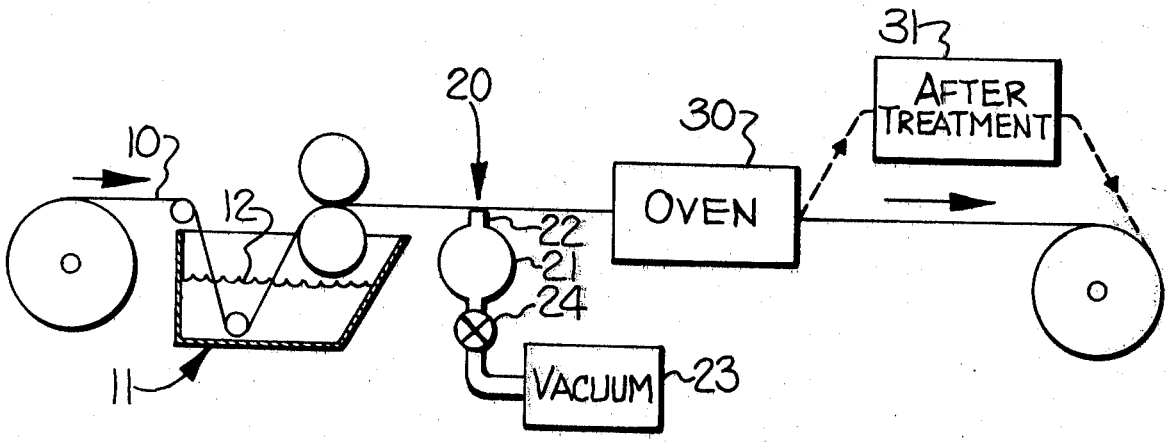
31
AFTER TREATMENT
20
30
OVEN
10
12
22
21
24
11
VACUUM
23

AQUEOUS FORMALDEHYDE TEXTILE FINISHING PROCESS

FIELD AND BACKGROUND OF THE INVENTION

This invention relates to the treatment of textile fabrics containing cellulosic fibers to impart crease resistance, and in particular relates to an improved durable press fabric finishing process using aqueous formaldehyde, Formaldehyde has long been recognized as a desirable finishing agent for fabrics containing cellulosic fibers. Formaldehyde is considerably lower in cost than the resin finishing agents currently used in most commercial durable press fabric finishing operations, and has enhanced durability. Additionally, unlike most resin-finished fabrics, formaldehyde-finished fabrics do not continue to liberate formaldehyde in storage, after initial removal.

However, despite widespread recognition of the desirable properties of formaldehyde and active scientific investigation for many years, as evidenced by numerous patents and publications describing finishing processes using aqueous formaldehyde, none of the processes heretofore known which use aqueous formaldehyde have been found suitable for routine application on a commercial scale. One of the principal factors limiting the commercial use of aqueous formaldehyde is the non-reproducibility of the finishing process in commercial applications. Traditional pad-dry-cure processes using aqueous formaldehyde have been found to be extremely variable and non-reproducible when practiced on a commercial scale. Unacceptable loss of fabric strength has also been observed in many of the proposed aqueous formaldehyde treatment processes.

Because of the aforementioned failings of prior aqueous formaldehyde processes, there have been continuing efforts to develop a suitable finishing process utilizing formaldehyde. One method which has been actively investigated and described in numerous patents involves the treatment of fabrics with formaldehyde in the vapor phase. However, this vapor phase technology requires specialized processing equipment and exacting processing conditions. For these and other reasons, the vapor phase formaldehyde technology has found limited acceptance commercially.

More recently, the application of aqueous formaldehyde at low wet pickup levels has been investigated as a means for overcoming the aforementioned problems. It has been proposed to apply aqueous formaldehyde mixed with a sulfur dioxide catalyst to the fabric by printing with an engraved roll to obtain a low wet pickup on the order of 15–35 percent, with the fabric being thereafter heated and cured in a conventional manner. While this process shows improvement over the earlier aqueous formaldehyde processes, it has certain disadvantages and limitations. The engraved roll used for applying the finishing agent is costly, and is subject to wear during continued use, resulting in a variation in the amount of finishing agent applied to the fabric. Additionally, with the engraved roll, it is difficult to accurately adjust and control the wet pickup level when changing to a fabric of a different weight, construction or color. Also, problems are presented in controlling and containing the fumes of the gaseous sulfur dioxide catalyst.

Summary Of The Invention

Accordingly, a primary object of the present invention is to provide a process for treating cellulosic fabrics with formaldehyde which substantially alleviates the problems mentioned above. A more specific object of this invention is to provide a practical and effective process for obtaining durable press properties in a textile fabric containing cellulosic fibers by treating the fabric with aqueous formaldehyde.

These and other objects are realized in accordance with the present invention by a process in which the fabric is first impregnated with an aqueous solution containing formaldehyde and a curing catalyst, and then a vacuum is applied to the impregnated fabric to remove excess impregnation solution and to provide a wet pickup of about 15–35 percent by weight. The thus treated fabric is then dried and cured.

Preferably, the impregnating of the fabric is carried out by immersing the fabric and thereby thoroughly saturating it with the impregnation solution. The impregnation solution preferably contains from about 1 to about 10 weight percent formaldehyde, and the curing catalyst preferably comprises a latent acid catalyst. The drying and curing of the fabric is preferably performed in a single step at temperatures from 250 to 450 degrees F.

While vacuum extraction techniques have been previously used in connection with resin finishing, vacuum extraction has not been heretofore known or suggested for use in the application of aqueous formaldehyde. Formaldehyde has a relatively low molecular weight and low vapor pressure. To those experienced in treatment of textile fabrics, it would be expected that the application of a very strong vacuum (in the neighborhood of 14" Hg.) to an aqueous formaldehyde impregnated fabric would result in removal of the volatile formaldehyde from the fabric. Unexpectedly however, it has been found that in the particular environment of the present invention, where the fabric is first impregnated and thoroughly saturated with an aqueous formaldehyde solution, and vacuum extraction is thereafter utilized to achieve a relatively low wet pickup of about 15–35 percent by weight, the efficiency of using the formaldehyde is actually increased rather than decreased, resulting in significantly reduced chemical comsumption, and thus providing considerable cost advantages. The present invention achieves a very high fixation of formaldehyde on the fabric, typically well in excess of 90 percent. Not only does this high rate of fixation contribute to reduced chemical consumption, but it also contributes to reduced formaldehyde concentration in the work environment surrounding the treatment apparatus. Further, it has been discovered that fabrics treated in accordance with the present invention have significantly reduced levels of liberated formaldehyde. This permits a reduction or elimination of the aftertreatments normally carried out to reduce residual formaldehyde in the fabric. This method of application has been found to provide significantly better uniformity in fabric properties than that achieved by the aforementioned engraved roll method of application or conventional pad methods of application.

The above as well as other features and advantages of the present invention will become apparent from the detailed description given hereinafter. It should be understood at the outset, however, that the detailed description and specific examples which follow, while indicating preferred embodiments of the invention, are given by way of illustration only and are intended to be understood as a broad enabling teaching directed to persons skilled in the applicable art, and are not to be understood as restrictive, since various changes and modifications within the spirit and scope of the invention will become apparent to those skilled in the art.

BRIEF DESCRIPTION OF THE FIGURE

The FIGURE is a schematic diagram of a preferred continuous operation according to the invention.

DETAILED DESCRIPTION

As illustrated in the FIGURE, a textile fabric 10 containing a blend of cotton and polyester fibers is directed continuously through a conventional pad apparatus generally indicated by the reference character 11, where it is immersed in and thoroughly impregnated with an impregnation solution 12 comprising an aqueous solution of formaldehyde.

The impregnation solution is prepared by diluting formalin with water to provide an aqueous solution containing from about 1 to about 10 percent by weight formaldehyde. The impregnation solution also contains a suitable catalyst for activating the formaldehyde. A preferred class of catalysts are the latent acid or Lewis acid catalysts, such as magnesium chloride, ammonium chloride, zinc chloride, zinc nitrate and like, which are well known to the finishing trade. One such catalyst which has been found to be particularly suitable is magnesium chloride. The concentration of the catalyst is not narrowly critical and is generally added to the impregnation solution in amounts conventionally used for this class of catalyst, typically in amounts ranging from about 1 to about 100 percent by weight of the formaldehyde present. The impregnation solution may also contain conventional finishing bath auxiliary agents such as surfactants, softeners, penetrants, leveling agents, antifoam agents and the like which are well known to the finishing trade. The surfactants used are preferably of the nonionic type, and many suitable such nonionic surfactants are available commercially and marketed specifically for textile finishing applications.

Upon leaving the pad bath, the thoroughly saturated fabric is directed across a vacuum extraction apparatus, generally indicated at 20. The vacuum extraction apparatus comprises an elongate pipe 21 extending across the width of the fabric, and having a slot 22 formed therein across which the fabric is directed. The slotted pipe is connected to a high vacuum source 23. Vacuum, which may be as high as about 14 inches Hg., is applied to the slotted pipe to suck off surface excess impregnation solution. The wet pickup level can be readily controlled by varying the vacuum applied to the fabric. A valve 24 or other suitable means may be provided for this purpose. Preferably, the application of vacuum is controlled so as to obtain a wet pickup level within the range of about 15–35 percent, and most desirably within the range of about 20–30 percent.

After passing by the vacuum extraction apparatus, about ½ to about 3 weight percent formaldehyde is present on the fabric. The fabric 10 is then directed through a curing oven 30 where it is heated to dry and cure the fabric. Preferably, the drying and curing of the fabric is performed in a single step at temperatures of from 250 to 450 degrees F. The curing oven may suitably comprise a conventional tenter which is capable of maintaining the fabric under widthwise tension while the drying and curing takes place. The curing of the thus impregnated fabric and vacuumed fabric results in a very high level of fixation of the formaldehyde on the fabric, well in excess of 90 percent and typically greater than 95 percent.

Following curing, the fabric optionally may be washed or subjected to other aftertreatments as indicated at 31 to remove residual formaldehyde. For example, residual formaldehyde may be removed by an aqueous wash, by an aqueous spray with heated water, by washing with a bath containing a formaldehyde scavenger such as urea, or by a combination of these aftertreatments.

Very significant reduction in residual formaldehyde can be achieved by adding diethylene glycol to the pad bath. This technique can in some instances eliminate the necessity for any aftertreatment to remove residual formaldehyde.

An exemplary formulation for an aqueous formaldehyde pad bath for use in carrying out the present invention is as follows:

| | Parts |
|---|---|
| Formalin (38% formaldehyde) | 65 |
| Magnesium Chloride | 16 |
| Nonionic Surfactant | 1 |
| Softener | 20 |
| Water | 898 |

The following example illustrates the results which are achieved by the aqueous formaldehyde vacuum extraction finishing process of this invention and compare such results with other known fabric finishing processes.

EXAMPLE

Aqueous formaldehyde was applied to samples of a polyester/cotton blend fabric by three methods:

1. Vacuum Extraction (The Invention) By passing the fabric through an aqueous formaldehyde pad bath followed immediately by vacuum extraction to remove excess solution and obtain a wet pickup of 31 percent.
2. Engraved Roll (Prior Art) By passing the fabric through a pad equipped with an engraved roll and printing aqueous formaldehyde on the fabric to obtain a wet pickup of 21 percent.
3. Conventional Pad (Prior Art) By passing the fabric through a conventional pad followed by squeezing to obtain a wet pickup of 52 percent.

The formaldehyde concentration in the above baths was adjusted, depending upon the wet pickup on the fabric, to give 1.2% total formaldehyde add-on for each application method. The fabrics were then dried and cured under similar conditions, and thereafter analyzed to determine the levels of free and bound formaldehyde. Fabric specimens were also tested by the sealed jar test to determine the level of liberated formaldehyde in the fabric. The results of these tests are given in the Table I.

TABLE I

| | Comparison of Formaldehyde Levels Aqueous Formaldehyde Finish | | |
|---|---|---|---|
| | Vacuum Extraction | Engraved Roll | Conventional Pad |
| Total $CH_2O$ (%) | 1.27 | 1.01 | 0.77 |
| Free $CH_2O$ (%) | 0.05 | 0.07 | 0.06 |
| Bound $CH_2O$ (%) | 1.22 | 0.94 | 0.71 |

TABLE I-continued

| | Comparison of Formaldehyde Levels Aqueous Formaldehyde Finish | | |
|---|---|---|---|
| | Vacuum Extraction | Engraved Roll | Conventional Pad |
| Fixation (%) | 96.1 | 92.9 | 92.6 |
| Liberated $CH_2O$ (ppm) | 964 | 1363 | 1148 |

All three test methods give relatively high fixation of formaldehyde, with the vacuum extraction method of the invention being significantly higher than the other two methods. The level of liberated formaldehyde in the fabric specimens was considerably lower in the fabric treated by the vacuum extraction method than in the fabric treated by the other two methods.

For purposes of comparison, the same three application methods were used to apply conventional glyoxal resin finish to the same type of fabric, with the fabrics being dried, cured and tested in a similar manner. The results of these tests are given in Table II below:

TABLE II

| | Comparison of Formaldehyde Levels Glyoxal Resin Finish | | |
|---|---|---|---|
| | Vacuum Extraction | Engraved Roll | Conventional Pad |
| Total Resin (%) | 2.55 | 3.26 | 3.38 |
| Total $CH_2OH$ (%) | .49 | .63 | .65 |
| Fixed Resin (%) | 2.12 | 3.05 | 2.96 |
| Fixed $CH_2OH$ (%) | .41 | .59 | .57 |
| Fixation (%) | 83.3 | 93.6 | 87.6 |
| Liberated $CH_2O$ (ppm) | 420 | 473 | 693 |

Surprisingly, the vacuum extraction method, when used for applying a conventional glyoxal resin finish, resulted in significantly lower formaldehyde fixation than in the other two methods of application.

Formaldehyde Concentration In Air

Measurements were made of the formaldehyde concentration in the work environments surrounding the fabric finishing operation. The Mine Safety Applicances Company test method was used for measuring the formaldehyde concentration. The results of these tests are set forth in Table III below:

TABLE III

| | Formaldehyde Concentrations In Air | | |
|---|---|---|---|
| | Vacuum Extraction | Engraved Roll | Conventional Pad |
| Formalin in Pad Bath (%) | 12 | 24 | 6.5 |
| $CH_2O$ in Air Around Pad | 1-3 | 1-15 | 9 |

From this test it is seen that the vacuum extraction method of this invention results in significantly lower formaldehyde in the work environment, as well as reduced formaldehyde waste due to evaporation.

FABRIC PROPERTIES

The fabric properties of the aqueous formaldehyde finished fabrics by the above three methods were measured and the results given in Table IV below:

TABLE IV

| | Fabric Properties Aqueous Formaldehyde Finish | | |
|---|---|---|---|
| | Vacuum Extraction | Engraved Roll | Conventional Pad |
| Durable Press: | | | |
| 1 Wash | 3.5 | 3.5 | 3.25 |
| 5 Washes | 3.5 | 3.5 | 3.25 |
| Shrinkage (%) | | | |
| 1 Wash: | | | |
| Warp | −0.56 | −0.28 | −0.56 |
| Fill | +0.28 | 0 | +0.28 |
| 5 Washes: | | | |
| Warp | −0.76 | −0.28 | −0.83 |
| Fill | +0.56 | 0 | 0 |
| Break (lb.): | | | |
| Warp | 99 | 106 | 103 |
| Fill | 45 | 45 | 48 |
| Tear (g): | | | |
| Warp | 1100 | 1333 | 1417 |
| Fill | 583 | 800 | 917 |
| Accelerotor Wt. Loss (%) | 4.05 | 3.83 | 3.77 |

This test shows that the durable press properties obtained by the vacuum extraction method of this invention are equal to that obtained by the engraved roll method, and significantly better than that obtained by the conventional pad method of application. The strength properties of the fabric finished by the vacuum extraction method is somewhat lower, but this would be expected due to the higher level of fixed formaldehyde in the fabric (See Table I).

AFTERTREATMENTS

Fabric samples treated by the aqueous formaldehyde vacuum extraction method of this invention were subjected to various aftertreatments for removal of residual formaldehyde and the liberated formaldehyde level was measured by AATCC Test Method 112-1978 (Chromotropic Acid Alternate). The aftertreatment methods included (1) a standard process wash with successive dip-immersions in a continuous washer, (2) a scavenger wash using a wash bath with a formaldehyde scavenger (urea), and (3) steaming by passing across a steam knife. An additional fabric sample was treated by the vacuum extraction method of this invention with the addition of diethylene glycol to the pad bath, and the cured and dried fabric was tested for residual formaldehyde both before and after washing as in (1) above. The results are shown in the following table:

TABLE V

| | Reduction of Liberated Formaldehyde Aqueous Formaldehyde Finish |
|---|---|
| | Liberated $CH_2O$ (ppm) |
| Not aftertreated | 964 |
| Aftertreated | |
| (1) Process Wash | 320 |
| (2) Scavenger Wash | 270 |
| (3) Steam | 269 |
| Bath Additive | |
| Diethylene Glycol without afterwash | 196 |
| Diehtylene Glycol with afterwash | LDL[1] |

[1]Less than the detection limit of AATCC Test Method 112-1978.

In the drawings and specification there have been set forth preferred embodiments of the invention, but it is to be understood that the invention is not limited thereto and may be embodied and practiced in other ways within the scope of the following claims.

That which is claimed is:

1. A process of treating a textile fabric containing cellulosic fibers to impart crease resistance, said process comprising impregnating said fabric with an aqueous solution containing formaldehyde and a curing catalyst, applying a vacuum to the impregnated fabric to remove excess impregnation solution and to provide a wet pickup of about 15 to 35 percent by weight, and drying and curing the thus treated fabric.

2. A process as set forth in claim 1 wherein the impregnation solution contains from about 1 to about 10 weight percent formaldehyde and said catalyst comprises a latent acid catalyst.

3. A process as set forth in claim 1 wherein said impregnating step comprises immersing the fabric and thoroughly saturating it with the impregnation solution.

4. A process as set forth in claim 1 wherein said step of applying a vacuum is performed so as to obtain a wet pickup of 20 to 30 percent.

5. A process as set forth in claim 1 wherein the drying and curing of the fabric is performed in a single step at temperatures of 250 to 450 degrees F.

6. A process of treating a textile fabric containing cellulosic fibers to impart crease resistance, said process comprising impregnating and thoroughly saturating said fabric in an aqueous solution containing formaldehyde and a curing catalyst, applying a vacuum to the impregnated fabric to remove excess impregnation solution and provide about ½ to 3 percent by weight formaldehyde on the fabric, and drying and curing the thus treated fabric and fixing at least 90 percent of the applied formaldehyde on the fabric.

7. A process as set forth in claim 6 wherein the catalyst in said impregnation solution is a latent acid catalyst, and the impregnation solution also includes a surfactant.

8. A process as set forth in claim 6 wherein the drying and curing of the fabric is performed in a single step at temperatures from 250 to 450 degrees F.

9. A process as set forth in claim 6 wherein said step of applying a vacuum to the fabric to remove excess impregnation solution is performed so as to provide a wet pickup of said solution on the fabric of about 15 to 35 percent by weight.

10. A process of treating a textile fabric containing cellulosic fibers to impart crease resistance, said process comprising impregnating and thoroughly saturating said fabric with an aqueous solution containing from about 1 to about 10 percent by weight formaldehyde, a latent acid catalyst, and a surfactant, applying vacuum to the impregnated fabric to remove surface excess impregnation solution and to provide a wet pickup of about 15 to 35 percent by weight, and drying and curing the thus treated fabric at a temperature of 250 to 450 degrees F. and chemically fixing on the fabric at least 90 percent of the applied formaldehyde.

11. A process as set forth in claim 10 wherein said latent acid catalyst comprises magnesium chloride and said surfactant comprises a nonionic surfactant.

12. A process as set forth in claim 10 wherein said drying step includes chemically fixing on the fabric at least 95 percent of the applied formaldehyde.

13. A process of treating a textile fabric containing cellulosic fibers to impart crease resistance, said process comprising advancing said fabric through a pad and saturating the fabric with an aqueous solution of from about 1 to about 10 percent by weight formaldehyde and an acid catalyst, directing the impregnated fabric from the pad and across a vacuum slot and applying a vacuum to the fabric to remove the surface excess impregnation solution and to provide a wet pickup of about 15 to 35 percent by weight, and directing the fabric from the vacuum slot through a curing oven and heating the fabric to a temperature of 250 to 450 degrees F. to dry and cure the fabric.

14. A process according to claim 13 wherein said step of directing the fabric through a curing oven is performed while maintaining the fabric under widthwise tension.

15. A process according to claim 14 including heating the fabric in the curing oven at about 400 degrees F. for about 20 seconds.

16. A process according to claim 13 wherein said step of heating to dry and cure the fabric includes chemically fixing on the fabric at least 95 percent of the applied formaldehyde.

* * * * *

UNITED STATES PATENT AND TRADEMARK OFFICE

CERTIFICATE OF CORRECTION

PATENT NO. : 4,396,390

DATED : August 2, 1983

INVENTOR(S) : James E. Hendrix and George L. Payet

It is certified that error appears in the above-identified patent and that said Letters Patent are hereby corrected as shown below:

On the title page

In the references cited:

3,165,374 "1/1905" should be --1/1965--.

"3,190,716" should be --3,199,716--.

3,841,832 "2/1973" should be --10/1974--.

In the abstract, line 3, after the word "fabric" insert --is--.

Column 3, line 8, "FIGURE" should be --DRAWING--.

Column 3, line 10, "FIGURE" should be --DRAWING--.

Column 3, line 14, "FIGURE" should be --drawing--.

Column 6, line 63, Table V, "Diehtylene" should be --Diethylene--.

Signed and Sealed this

*Fifteenth* Day of *November 1983*

[SEAL]

*Attest:*

GERALD J. MOSSINGHOFF

*Attesting Officer*

*Commissioner of Patents and Trademarks*